United States Patent [19]

Steenson et al.

[11] 4,272,065

[45] Jun. 9, 1981

[54] BUILDING PANEL ERECTION BRACKETS

[75] Inventors: Thomas W. Steenson, Richmond Hill; W. Donald Paton, Aurora, both of Canada

[73] Assignee: Butler Manufacturing Company, Kansas City, Mo.

[21] Appl. No.: 120,837

[22] Filed: Feb. 12, 1980

[51] Int. Cl.[3] ..... B66C 1/22

[52] U.S. Cl. ..... 269/46; 269/904; 294/81 R

[58] Field of Search ..... 269/46, 49, 321 S, 321 F, 269/246; 294/89, 81 R

[56] References Cited

U.S. PATENT DOCUMENTS

| | | | |
|---|---|---|---|
| 3,297,353 | 1/1967 | Carlsen | 294/81 R |
| 4,128,267 | 12/1978 | Niblett et al. | 294/81 R |

FOREIGN PATENT DOCUMENTS

| | | | |
|---|---|---|---|
| 15834 | of 1916 | United Kingdom | 269/46 |

*Primary Examiner*—Robert C. Watson

*Attorney, Agent, or Firm*—Shoemaker and Mattare, Ltd.

[57] ABSTRACT

An improved building panel erection bracket includes a panel lifting plate which is rotatable and retractable. The panel erection bracket permits a building panel to be fixed into the final position thereof before the erection bracket is detached from the panel.

4 Claims, 5 Drawing Figures

FIG. 1.
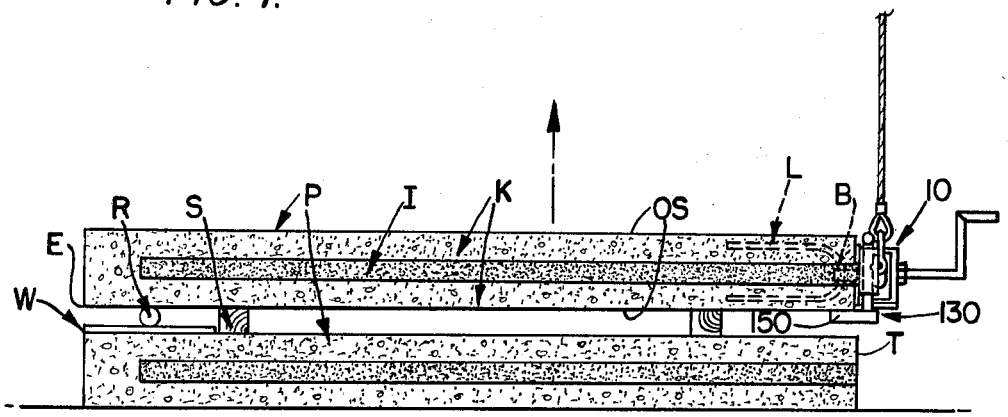
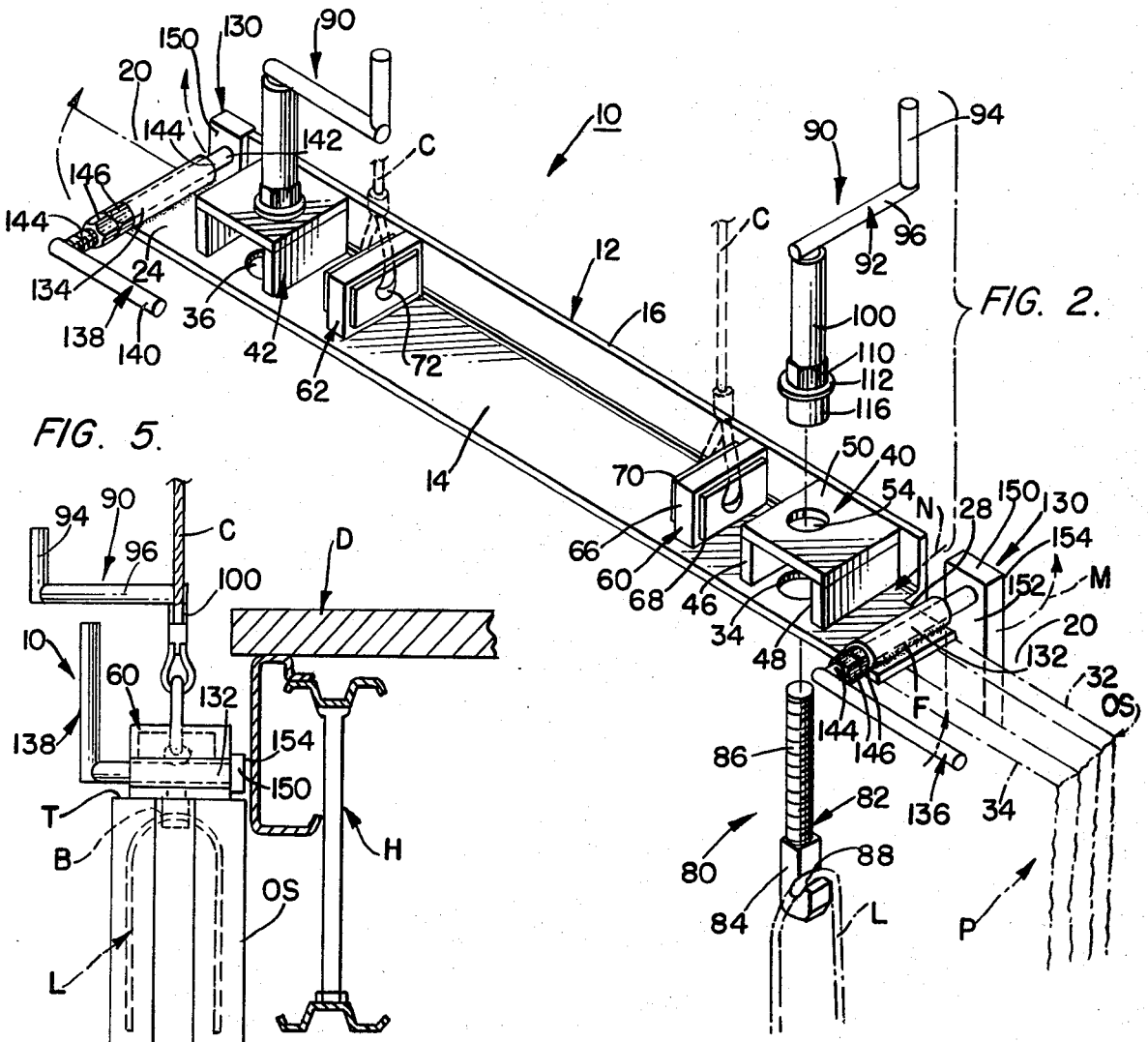
FIG. 2.
FIG. 5.
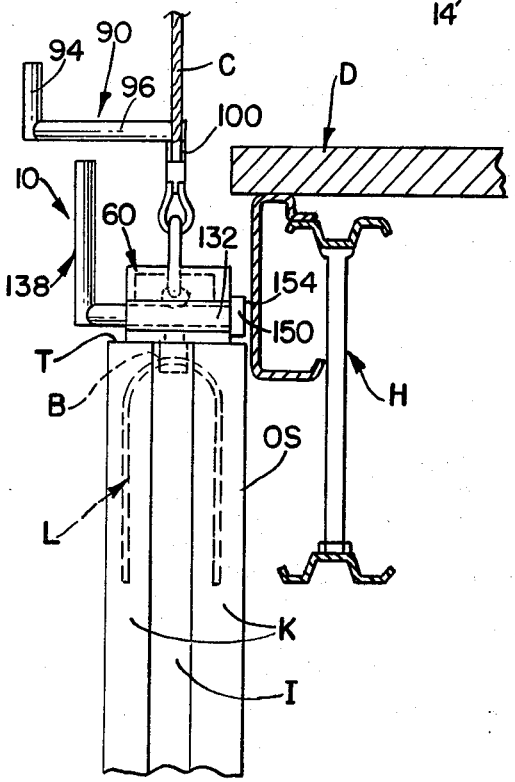

BUILDING PANEL ERECTION BRACKETS

BACKGROUND OF THE INVENTION

The present invention relates in general to building structures, and, more particularly, to means for erecting insulated concrete wall panels.

Many buildings use precast concrete panels which are shipped to a building site, then erected into place. The assignee of the present invention produces such panels under the name COREWALL ®. These panels include a layer of insulation sandwiched between a pair of concrete layers.

Heretofore, these panels have been moved into place using several different means. For example, lifting hooks have been cast into the front face of a panel. However, such means can only be used on panels which are not exposed, as the lifting hooks create unsightly marks on the face of the panel.

Threaded inserts have been used extensively in precast concrete panels. It is noted that COREWALL ® panels are normally sawcut to length, which for all practical purposes, precludes the use of threaded inserts.

Since the aforementioned COREWALL ® panels have an architectural finish on both sides, and full width insulation is required at the top of the panel, it is necessary to engage both layers of concrete when erecting the panels. This is accomplished by using two hairpin-shaped lifting hooks which are embedded in both layers of concrete. An erection bracket is then attached to these lifting hooks by two high strength "J"-bolts which are securely attached to a lifting carriage.

The bracket and carriage described above have been quite satisfactory for panels which extend above eave height. However, some buildings are designed with the top of the panel stopping just below the eaves height.

The erection bracket as described above is not suitable for use with panels stopping below eaves height, as the extended lifting plates will interfere with the final position of the panel. Using the known panel lifting device, the bolts had to be loosened, and the bracket taken off. A problem arises in the holding of the panel in position until a clevis or some other means of attachment can be made. This makes such prior lifting devices not only costly in time and effort, but creates a dangerous situation as well.

Accordingly, there is need for a means of positioning a building panel, which means will not interfere with the final position of the panel.

SUMMARY OF THE INVENTION

The device embodying the teachings of the present invention permits a panel, such as a COREWALL ® panel to be properly, efficiently and safely positioned in a building wherein a building member, such as an eaves member, or the like, is located closely adjacent the top of the panel.

The device includes lifting plates rotatably and retractably mounted on a panel lifting carriage. The plates are attached to a hand crank and are rotated and retracted at suitable times during the panel positioning procedure.

A panel can thus be fixed into the final position thereof before detaching the lifting carriage therefrom. The panel is thus properly, efficiently and safely moved into the final position thereof.

OBJECTS OF THE INVENTION

It is the main object of the present invention to orient a prefabricated building panel into final position adjacent an overhanging building member in a safe, efficient manner.

It is another object of the present invention to orient a COREWALL ® building panel into final position adjacent an overhanging building member in a safe, efficient manner.

It is yet another object of the present invention to orient a COREWALL ® building panel into final position adjacent an eaves member in a safe, efficient manner.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 1 is a side elevation view of a pair of building panels with a top panel being attached to a lifting carriage embodying the teachings of the present invention.

FIG. 2 is an exploded perspective of a building panel lifting carriage embodying the teachings of the present invention.

FIG. 5 is an end view of a building panel being finally positioned adjacent an eave member using a lifting carriage embodying the teachings of the present invention.

DETAILED DESCRIPTION OF THE INVENTION

Shown in FIG. 1 is a pair of panels P each of which includes a layer of insulation I sandwiched between layers of concrete K. The panels have outer surfaces OS and are stored in a horizontal position with spacer blocks S interposed therebetween. Preferably, the panels P are COREWALL ® panels.

Each panel has a hairpin-shaped lifting pin L therein straddling the insulation layer and being embedded in the concrete layers. The bight B of each pin L is spaced above the top of the insulation layer to be exposed for connection to a panel lifting means, as will be discussed below. The topmost portion of each pin is slightly lower than the topmost surface T of the concrete layers as best shown in FIG. 5.

Figure 3:
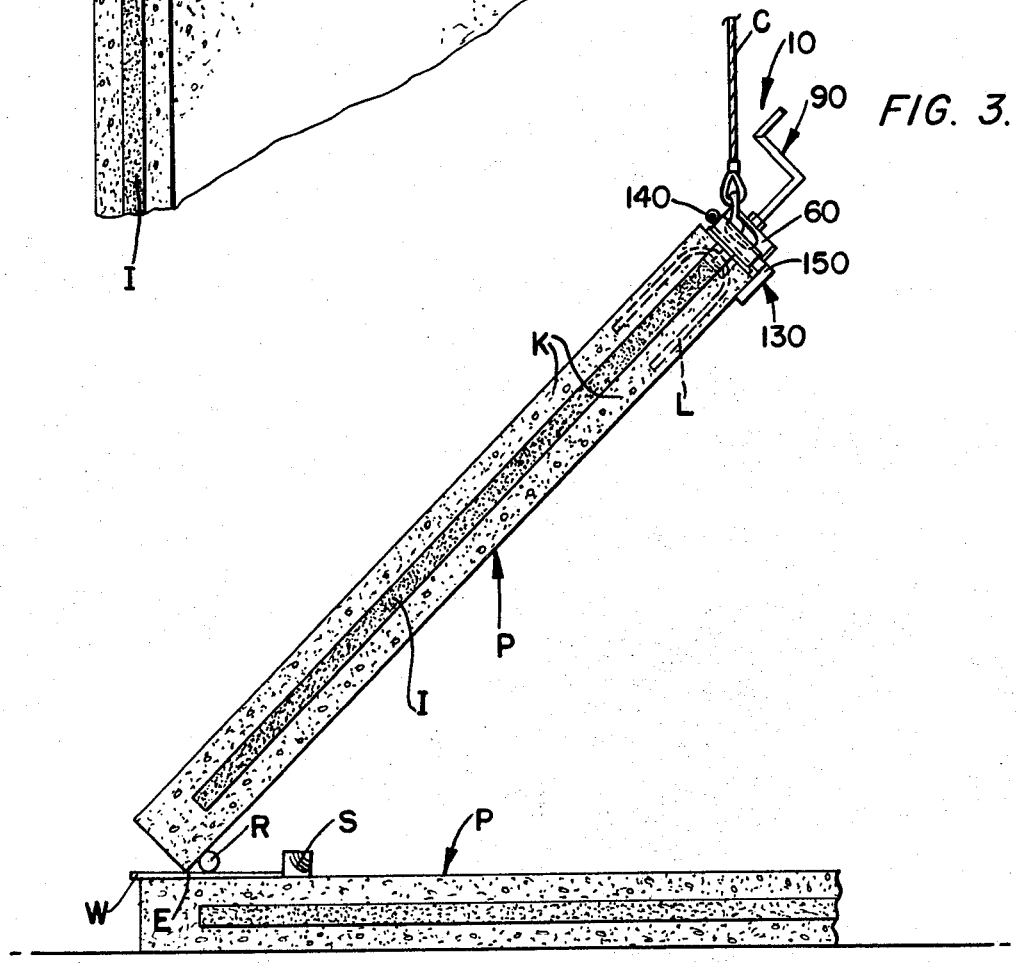
FIG. 3 is an end elevation view of a pair of building panels with a top panel being attached to a lifting carriage embodying the teachings of the present invention and being tilted into an upright orientation.

Preparatory to lifting a panel, a pipe R and a pallet W are positioned between the panel to be lifted and the means beneath that panel as shown in FIG. 1. The pipe permits proper movement of the lifted panel as that panel is being tilted upwardly as shown in FIG. 3, and the pallet protects the lowermost edge E of the lifted panel and the panel supporting means from damage due to contact between those two elements during the lifting motion.

A panel erection bracket 10 is best shown in FIG. 2. The bracket includes an L-shaped carriage 12 having an elongate planar base 14 which is width-wise sized to span the panel thickness and an upright leg 16 integrally attached to the base 14. The base is longer than the leg 16 so that a notch 20 is defined on each end of the carriage, and aprons 22 and 24 are defined by the base adjacent those notches. The width of the base is essentially equal to the thickness of the panel so that longitudinal side edges 28 and 30 of the base at the notch are essentially flush with surfaces 32 and 34 of the panel P. Protective plates, such as rasps, or the like, can be mounted on the front surface of the leg 16, if so desired.

A pair of mounting bolt receiving holes 34 and 36 are defined in the base 14 to be spaced apart along the longitudinal centerline of that base. Block U-shaped channel brackets 40 and 42 straddle the holes, and each bracket includes a first leg 46 and a second leg 48 which are welded to the base 14. A spanner plate 50 forms the top of each bracket and is welded to the legs 46 and 48. A crank arm receiving hole 54 is defined in the bracket top to be aligned with the bolt receiving hole associated therewith. The brackets can also be welded to the leg 16 to further secure the brackets to the carriage 12.

A pair of tether brackets 60 and 62 are fixed to the carriage to be spaced apart along the longitudinal centerline of the base 14 and to be inwardly spaced from the channel brackets 40 and 42, respectively. Each tether bracket is adjacent one of the channel brackets, and the tether brackets are spaced apart a distance sufficient to provide stability to a lifted panel as will be apparent from the discussion below. Each tether bracket includes a central block 66 sandwiched between a pair of outer spacer plates 68 and 70. The central block is fixably mounted on the base 14 and the spacer plates are fixed to the central block and provide proper sizing to the tether brackets for accepting hoisting cables used to lift the panel. The central block can be attached to the leg 16 to further affix that block to the carriage.

Figure 4:
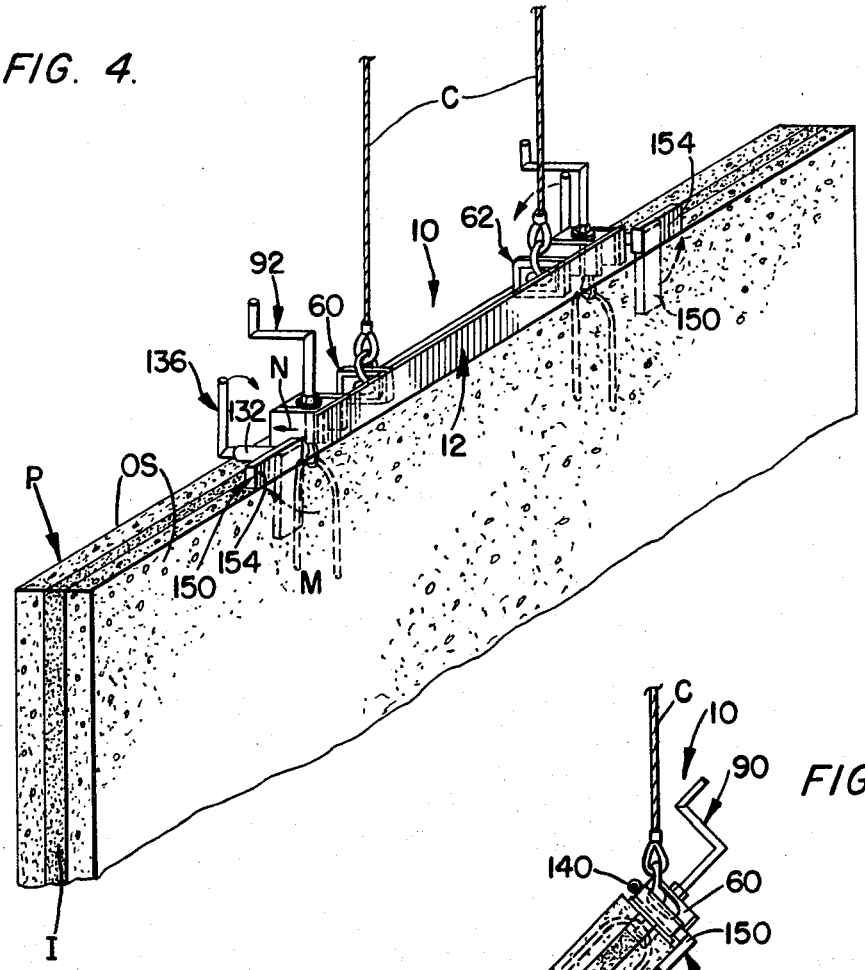
FIG. 4 is a perspective showing a building panel being suspended using a lifting carriage embodying the teachings of the present invention.

Coincident circular tether holes 72 are defined through the central block in the outer plates to receive a lifting cable C for attaching a panel to a hoisting means (not shown). The tether holes can also be oblong, as shown in FIG. 4, if so desired.

A panel attaching means 80 is best shown in FIG. 2 to include a J-bolt 82 having a head 84 attached to a threaded body 86. The head includes channel 88 which accommodates a lifting pin L, and the bolt body is received through the aligned bolt and crank arm receiving holes. The brackets 40 and 42 allow the J-bolts to be properly attached to the pins L.

A crank arm 90 includes an L-shaped handle 92 having a handgrip 94 and a rod 96 attached thereto. A tubular arm 100 is attached to the rod 96 on the end thereof remote from the handgrip 94 to be rotated about the longitudinal centerline thereof by circumrotation of the handgrip about the longitudinal centerline of the arm 100.

A polygonal nut 110 is attached to the end of the tubular arm 100 which is remote from the rod 96 as by welding or the like. The nut 110 is attached to a washer 112 as by welding or the like, and a tubular extension 116 is attached to the washer as by welding or the like.

The nut 110 is internally threaded to threadably receive the bolt body 86 in a secure manner, the washer is annular to accommodate the body 86 therethrough, and the tubular extension has a bore defined longitudinally thereof to accommodate the bolt body therethrough. The tubular extensions are accommodated through the crank arm receiving holes defined in the brackets 40 and 42, and the washer abuts the top surface of the spanner plates of those brackets.

As indicated in FIGS. 2 and 3, the bolt head is attached to a lifting pin, then the threaded body is positioned through the aligned holes and threadably coupled to the crank arm by engaging the body in the nut 110 and rotating the crank arm. The J-bolt is taken up until the panel is securely attached to the carriage 12. The cables C can then be attached to the tether brackets, and the panel moved as indicated in FIG. 3 into an upright position as shown in FIG. 4 to be suspended from the cables. The panel is then moved into position adjacent a roof deck D, or a purlin, or the like, as shown in FIG. 5. While still suspended via the cables C, the panel is maneuvered into the desired position.

As above-discussed, if the panel is to be located in a position wherein proper positioning thereof is difficult with the cables still attached, such as adjacent an eaves member H, or the like, prior art devices suffer drawbacks. Such drawbacks are not suffered by the device embodying the teachings of the present invention, as the erection bracket can remain attached to the panel while that panel is being maneuvered into the final position thereof.

The present device includes a panel lifting means 130 mounted on the carriage 12. The panel lifting means 130 is best shown in FIG. 2, and includes a pair of tubular collars 132 and 134 each attached, as by welding F, to the base aprons 22 and 24 to have one end thereof flush with the longitudinal edge 28 and the other end thereof flush with longitudinal edge 30. The tubular collars have bores defined longitudinally therethrough. Each of a pair of L-shaped arms 136 and 138 has a handgrip portion 140 and a base portion 142. Threads 144 are defined on the base portion 142. A pair of adjusting nuts 146 are threadably attached to the base portion so that the panel lifting means 130 can be adjusted to accommodate panels of various thicknesses. Panel thicknesses can be, for example, 8 inches or 10 inches, or the like. The base portion is received through the bore of the tubular collar associated therewith. A panel lifting plate 150 is attached to each base portion on the end thereof remote from the handgrip. The lifting plates are rectangular and are attached at one end thereof to the base portions for rotation therewith. Each lifting plate has an inner surface 152 and an outer surface 154.

The arm base portions are slidably and rotatably accommodated in the collar bores so that circumrotation of the handgrip portions rotates the lifting plates correspondingly about a center defined by the base portion, and movement axially of the base portion retracts the lifting plates. Such movement is indicated in FIG. 2 by arrows M and N, respectively.

Each base rod portion 142 can move axially thereof within the associated collar to move the lifting plate from a position wherein the inner surface 152 is flush with panel outer surface OS, as shown in FIG. 2, to assist in the panel lifting process shown in FIGS. 3 and 4, to a position wherein plate outer surface 154 is essentially flush with the panel outer surface OS and spaced therefrom as best shown in FIG. 5. The two plane movement of the plates 150 is also indicated in FIG. 4 wherein the plates are moved from the positions shown therefor in phantom lines, to the positions thereof shown in solid lines.

The panel erection bracket can be used to align a panel with a building structural member, such as a purlin, an eave member, or the like, while that panel is still suspended via the cable C and the carriage 12.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. An improvement in a building panel lifting means which is used to position an insulated building panel having lifting brackets embedded therein, the lifting means including a base member, cable attaching means fixed to the base member, bolt accommodating means fixed to the base member, a bolt attachable to the embedded lifting bracket and bolt attaching means for attaching the bolt to the base member via the bolt accommodating means, the improvement comprising:

a panel lifting means rotatably and retractably mounted on the base member, said panel lifting means including a collar mounted on the base member and having a bore defined therethrough, a crank having one portion thereof rotatably and retractably received in said collar and a lifting plate attached to said crank for rotation and retraction therewith, said crank being retractable transversely of said base member.

2. The improvement defined in claim 1 wherein the panel lifting means is located adjacent one end of the base member.

3. The improvement defined in claim 2 wherein the base member has a notch defined at one end thereof in which said lifting plate is located.

4. The improvement defined in claim 1 including a pair of lifting means.

* * * * *